US007257910B2

(12) United States Patent
Underwood

(10) Patent No.: US 7,257,910 B2
(45) Date of Patent: Aug. 21, 2007

(54) IMPACT RESISTANT BREAKER DEPLOYMENT SYSTEM FOR AN EXCAVATING MACHINE

(76) Inventor: Lowell Underwood, P.O. Box 520, Prosper, TX (US) 75078

( * ) Notice: Subject to any disclaimer, the term of this patent is extended or adjusted under 35 U.S.C. 154(b) by 0 days.

(21) Appl. No.: 11/504,994

(22) Filed: Aug. 16, 2006

(65) Prior Publication Data

US 2006/0272184 A1 Dec. 7, 2006

Related U.S. Application Data

(63) Continuation of application No. 11/362,670, filed on Feb. 27, 2006, which is a continuation-in-part of application No. 10/871,898, filed on Jun. 18, 2004, now Pat. No. 7,117,618, which is a continuation-in-part of application No. 10/150,057, filed on May 17, 2002, now Pat. No. 6,751,896, which is a continuation-in-part of application No. 09/624,099, filed on Jul. 24, 2000, now Pat. No. 6,430,849.

(51) Int. Cl.
*E02F 3/96* (2006.01)

(52) U.S. Cl. ..... 37/403; 37/903

(58) Field of Classification Search ..... 37/403–410, 37/347, 352–362, 468, 903
See application file for complete search history.

(56) References Cited

U.S. PATENT DOCUMENTS 3,865,013 A 2/1975 Mastaj
4,070,772 A 1/1978 Montomura et al.
4,100,688 A 7/1978 Grist
4,810,162 A 3/1989 Foster
4,869,002 A 9/1989 Glenn
5,277,264 A 1/1994 Song et al.
5,373,652 A 12/1994 Olsson
5,451,135 A 9/1995 Schempf et al.
5,549,440 A 8/1996 Cholakon et al.
5,689,905 A 11/1997 Ibusuki
6,085,446 A 7/2000 Posch
6,120,237 A 9/2000 Cummings et al.
6,269,560 B1 8/2001 Pratt

OTHER PUBLICATIONS

Komatsu Mini-Excavator, PC03-2F brochure sheets (3 pp.), dated Apr. 2000.

*Primary Examiner*—Christopher J. Novosad
(74) *Attorney, Agent, or Firm*—Storm LLP; John G. Fischer

(57) ABSTRACT

Disclosed is an excavating machine, representatively a tracked excavator, having a boom stick portion on which both an excavating bucket and a hydraulic breaker are mounted for hydraulically driven pivotal movement between first and second limit positions. The bucket may be operated independently of the breaker for digging operations. Similarly, the breaker may be operated independently of the bucket for refusal material-breaking operations. The same excavating machine may now use the bucket and breaker in a rapid and continuous exchange to permit frequent removal of small quantities of broken refuse material with the bucket, exposing the bucket and breaker to fresh refuse material. The excavating machine disclosed incorporates an impact resistant deployment system with bifurcated and lubricated trunnion pivots and an in-line pivot restriction, or stop. The system provides a breaker assembly connection that permits quick installation and removal of the breaker, and significantly greater durability.

19 Claims, 8 Drawing Sheets

IMPACT RESISTANT BREAKER DEPLOYMENT SYSTEM FOR AN EXCAVATING MACHINE

CROSS REFERENCE TO RELATED APPLICATION

This application is a continuation-in-part of U.S. application Ser. No. 10/871,898, filed Jun. 18, 2004 now U.S. Pat. No. 7,117,618, which is a continuation-in-part of U.S. application Ser. No. 10/150,057, filed May 17, 2002, now U.S. Pat. No. 6,751,896, which is a continuation-in-part of U.S. application Ser. No. 09/624,099, filed Jul. 24, 2000, now U.S. Pat. No. 6,430,849. This is also a continuation of U.S. application Ser. No. 11/362,670, filed Feb. 27, 2006. All applications from which priority is claimed are hereby incorporated by reference.

TECHNICAL FIELD OF THE INVENTION

The present invention generally relates to a material handling apparatus and, in a preferred embodiment thereof, more particularly relates to an excavating machine, representatively a tracked excavator, having operatively attached to the stick portion of its boom a specially designed combination bucket and breaker structure which uniquely permits the excavator operator to selectively carry out either digging or refusal material breaking tasks without having to change out equipment on the stick.

BACKGROUND OF THE INVENTION

Large scale earth excavation operations are typically performed using a powered excavating apparatus, such as a tracked excavator, having an articulated, hydraulically pivotable boom structure with an elongated, pivotal outer end portion commonly referred to as a "stick." Secured to the outer end of the stick is an excavating bucket which is hydraulically pivotable relative to the stick between "closed" and "open" positions. By pivotally manipulating the stick, with the bucket swung to a selected operating position, the excavator operator uses the bucket to forcibly dig into the ground, scoop up a quantity of dirt, and move the scooped up dirt quantity to another location, such as into the bed of an appropriately positioned dump truck.

A common occurrence during this conventional digging operation is that the bucket strikes refusal material (in excavation parlance, a material which "refuses" to be dug up) such as rock which simply cannot be broken and scooped up by the bucket. When this occurs it is typical practice to stop the digging operation, remove the bucket from the stick, and install a hydraulically operated "breaker" on the outer end of the stick in place of the removed bucket. The breaker has, on its outer end, an oscillating tool portion which rapidly hammers the refusal material in a manner breaking it up into portions which can be subsequently dug up. After the breaker has been utilized to break up the refusal material, the operator removes the breaker from the stick, replaces the breaker with the previously removed bucket, and resumes the digging operation with the bucket.

While this procedure is easy to describe, it is a difficult, laborious and time-consuming task for the operator to actually carry out due to the great size and weight of both the bucket and breaker which must be attached to and then removed from the stick, and the necessity for the operator to climb into and out of the high cab area of the excavator (often in inclement weather) to effect each bucket and breaker change-out on the stick. This sequence of bucket/breaker/bucket change-out, of course, must be laboriously repeated each time a significant refusal area is encountered in the overall digging process.

A previously utilized alternative to this single excavator sequence is to simply provide two excavators for each digging project—one excavator having a bucket attached to its boom stick, and the second excavator having a breaker attached to its boom stick. When the bucket-equipped excavator encounters refusal material during the digging process, it is simply moved away from the digging site, and the operator climbs down from the bucket-equipped excavator, walks over to and climbs up into the breaker-equipped excavator, drives the breaker-equipped excavator to the digging site, and breaks up the encountered refusal material. Reversing the process, the operator then switches to the bucket-equipped excavator and resumes the digging process to scoop up the now broken-up refusal material.

While this digging/breaking technique is easier on the operator, it is necessary to dedicate two large and costly excavators to a given digging task, thereby substantially increasing the total cost of a given excavation task. A modification of this technique is to use two operators—one to operate the bucket-equipped excavator, and one to operate the breaker-equipped excavator. This, of course, undesirably increases both the manpower and equipment cost for a given excavation project.

Another attempt to solve this problem is disclosed in U.S. Pat. No. 6,085,446 and U.S. Pat. No. 4,100,688 for an excavating machine having a motorized milling tool attached to the back of the bucket. A primary disadvantage of these devices is complexity, cost, and reliability. Another disadvantage is the weight that must be continuously carried by the bucket. The additional weight substantially reduces the carrying capacity and mobility of the bucket. Another disadvantage to the device of U.S. Pat. No. 6,085,446 is that the back of the bucket cannot be used to smooth or pad the soil, as is a well-known practice in the industry. Another disadvantage is that surface rock is not subject to an overburden pressure, so it generally fails faster under compression and impact forces than by the shearing forces of a scraping and gouging rotary drilling tool.

Another attempt to solve this problem is disclosed in U.S. Pat. No. 4,070,772 for an excavating machine having a hydraulic breaker housed inside, or on top of, the boom stick. A primary disadvantage of this device is that it is extremely complex and expensive. Another disadvantage of this device is that it cannot be retrofit to existing excavators. Another disadvantage of this device is that the size of the breaker is limited. Another disadvantage of this device is that the bucket must be fully stowed to access the breaker and vice versa, making simultaneous operation impractical.

Another attempt to solve this problem is disclosed in U.S. Pat. No. 5,689,905 for another excavating machine having a hydraulic breaker housed inside, or on top of, the boom stick. In this device, the chisel portion of the breaker is removed when not in use. A primary disadvantage of this device is that it fails to permit immediate, unassisted switching from breaker to bucket, and thus simultaneous operation is impossible. Another disadvantage of this device is that it requires manual handling of the extremely heavy chisel tool each time the operator desires to convert to a breaker or bucket operation. Another disadvantage of this device is that it is extremely complex and expensive. Another disadvantage of this device is that it cannot be retrofit to existing excavators.

A more recent attempt to solve this problem is disclosed in U.S. Pat. No. 6,751,896 for an excavating machine having a boom stick portion on which both an excavating bucket and a hydraulic breaker are mounted for hydraulically driven pivotal movement between first and second positions. A deployment system is disclosed having a bracket for closely aligned pivotal support of both the breaker and a single hydraulic cylinder on a single bracket. While this design is a marked improvement over the prior art, its primary disadvantage is that it lacks the desired level of durability at the first pivot and extension limiting (stop) mechanisms to tolerate the massive reciprocating loads of operation over time. Another disadvantage is that it is difficult to disassemble the first pivot to replace tool components. Another disadvantage is that the means for lubricating the bearing surface of the first pivot was ineffective and weakened the first pivot assembly. Another disadvantage is that it suffers durability loss from exposure of mechanical fasteners to the excavated material.

As can be readily appreciated from the foregoing, a need exists for an improved design for carrying out the requisite digging and refusal material-breaking portions of an overall excavation operation in a manner eliminating or at least substantially eliminating the above-mentioned problems, limitations and disadvantages commonly associated with conventional digging and breaking operations. It is to this need that the present invention is directed. In particular, there is a need for a new design with superior durability to the designs disclosed in U.S. Pat. No. 6,751,896.

SUMMARY OF THE INVENTION

The present invention is a marked improvement over the designs disclosed in U.S. Pat. No. 6,751,896. In carrying out principles of the present invention, in accordance with a preferred embodiment thereof, an excavating machine, representatively a tracked excavator, is provided with a specially designed pivotable boom stick assembly that includes a boom stick having first and second excavating tools secured thereto for movement relative to the boom stick. Illustratively, the first excavating tool is an excavating bucket secured to the boom stick for pivotal movement relative thereto between a first position and a second position, and the second tool is a breaker secured to the boom stick for pivotal movement relative thereto between a stowed position and an operative position.

A hydraulically operable drive apparatus is interconnected between the boom stick and the bucket and breaker and is usable to pivotally move the bucket between its first and second positions, and to pivotally move the breaker between its stowed and operative positions. Representatively, the drive apparatus includes a plurality of hydraulic cylinder assemblies operatively interconnected between the boom stick and the bucket and breaker.

The bucket, when the breaker is in its stowed position, is movable by the drive apparatus to the second bucket position and is usable in conjunction with the boom stick, and independently of the breaker, to perform a digging operation. The breaker, when the bucket is in its first position, is movable by the drive apparatus to the breaker's operative position and is usable in conjunction with the boom stick, and independently of the bucket, to perform a breaking operation. Accordingly, the excavating machine may be advantageously utilized to perform both digging and breaking operations without equipment change-out on the boom stick.

A primary advantage of the present invention's various embodiments is that it provides an extremely durable trunnion assembly for pivotal connection of the tool to the bracket. Another advantage is that it provides a new and durable stop mechanism, configured to avoid distortion of the side plates. Another advantage is that it is easy to disassemble the trunnion assembly to replace or service tool components. Another advantage is that it provides a reliable and effective means for lubricating the bearing surface of the trunnion assembly to ensure reliable operation of the tool.

In accordance with a preferred embodiment thereof, an excavating tool system for use on an excavating machine is provided. A bracket is located on the underside of a boom stick. The bracket has a first pivot and a second pivot. The first pivot is a trunnion. An excavating tool is pivotally secured at one end to the trunnion. The excavating tool has a third pivot located thereon between its one end and its opposite end. A hydraulic cylinder is pivotally secured at one end to the second pivot and pivotally secured on its opposite end to the third pivot. In the preferred embodiment, the pivotal attachment of the excavating tool to the bracket is bifurcated, thus comprising a pair of coaxial trunnions.

In the preferred embodiment, the centers of the trunnions are located coaxially on the bracket sides slightly further from base than the location of the second pivot.

In a preferred embodiment of the present invention, each trunnion comprises an outer plate and a cylindrical bearing extending from the outer plate. A plurality of bolt holes extends through the outer plate and the sleeve bearing. In a more preferred embodiment, a hub extends from the sleeve bearing. In the more preferred embodiment, the outer plate and hub are also cylindrical.

The mounting bracket further comprises a base and a pair of parallel bracket sides extending upward from the base, each having a hub socket and a plurality of threaded holes arranged generally symmetrically around the hub sockets. The threaded holes are aligned with the bolt holes for receiving threaded fasteners (such as bolts) for attaching the trunnions to the mounting bracket sides.

In a more preferred embodiment, the trunnion further comprises a lubrication system. In the preferred embodiment, the lubrication system comprises a bore in the outer plate. A fluid channel extends from the bore to the outer surface of the bearing. A lubrication connection, such as a grease cert, is attached to the fluid channel inside the bore.

In another preferred embodiment of the present invention, a stop is formed on each bracket side. A stop bar is located on one end of the excavating tool such that the stop bar engages the stop members to limit the pivotal rotation of the excavating tool.

These embodiments have the advantage of being easily retrofit onto excavating machines without modification of the hydraulic system. An additional advantage is the lower cost of materials and installation. Optionally, an uncontrolled hydraulic or pneumatic cylinder may be used to prevent free fall of the breaker upon release of the latch-lock. An advantage of this embodiment is increased safety.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

DETAILED DESCRIPTION OF THE INVENTION

Figure 1:
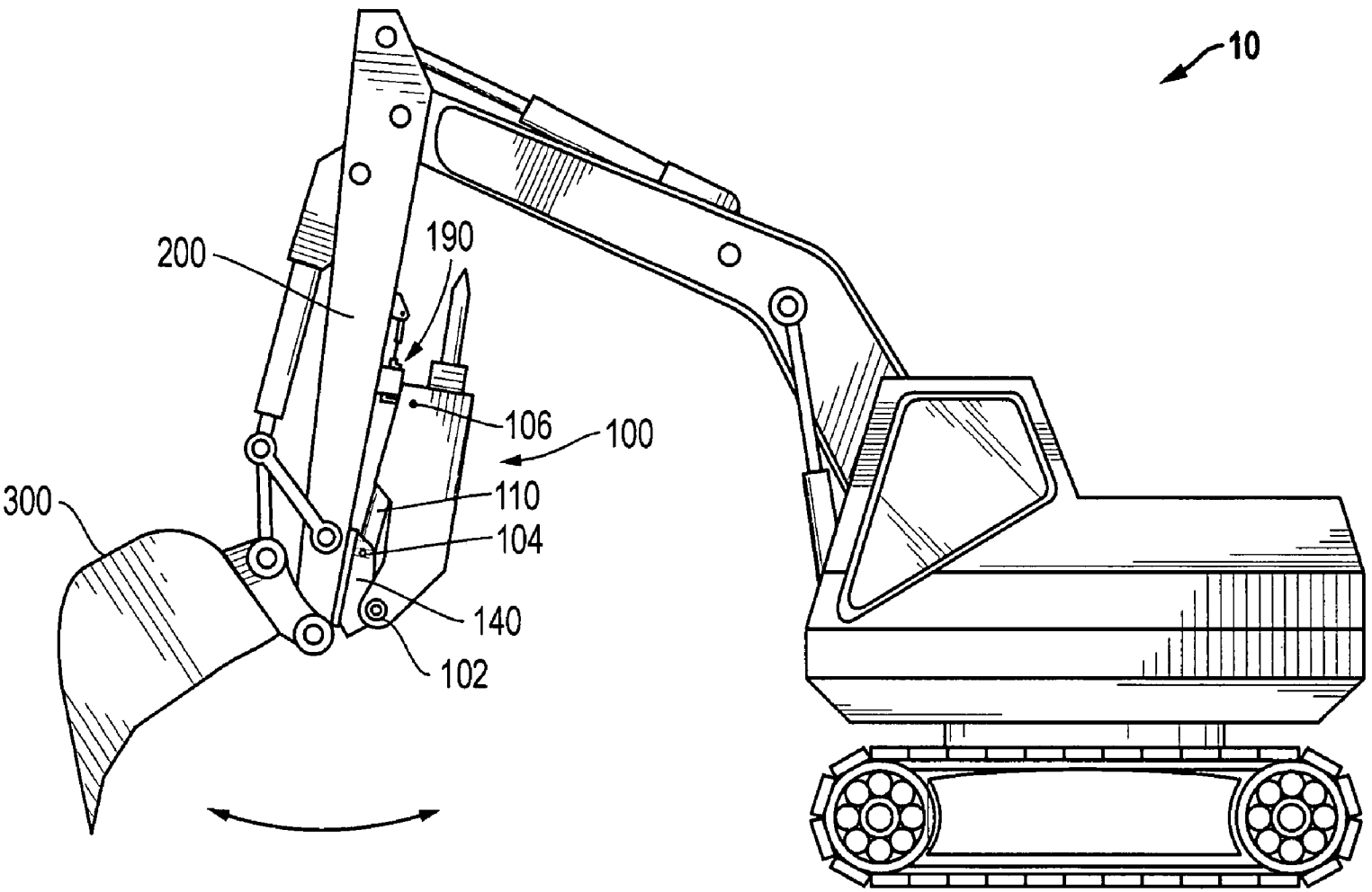
FIG. 1 is a side view of an excavating machine.

Refer now to the drawings wherein depicted elements are, for the sake of clarity, not necessarily shown to scale and wherein like or similar elements are designated by the same reference numeral through the several views.

FIG. 1 discloses earth-excavating machine 10 in accordance with a preferred embodiment of the present invention. A breaker assembly 100 is mounted on boom stick 200 in addition to excavating bucket 300. Breaker assembly 100 is an excavating tool pivotally attached to excavating machine 10 at a first pivot 102, a second pivot 104, and a third pivot 106. A bracket 140 is rigidly attached to boom stick 200 by welding or other means of secure attachment. In the preferred embodiment, breaker assembly 100 is pivotally attached to a bifurcated first pivot 102 on bracket 140.

A single hydraulic cylinder assembly 110 is pivotally attached at one end to second pivot 104 on bracket 140. Hydraulic cylinder assembly 110 is pivotally attached at its other end to third pivot 106 on breaker assembly 100. In the most preferred embodiment, the distance between first pivot 102 and second pivot 104 is less than the distance between first pivot 102 and the third pivot 106. A latch 190 is located on boom stick 200. When breaker assembly 100 is in the retracted position, latch 190 engages strike 132 (best seen in FIG. 4) so that breaker assembly 100 remains in the locked or stowed position.

Figure 2:
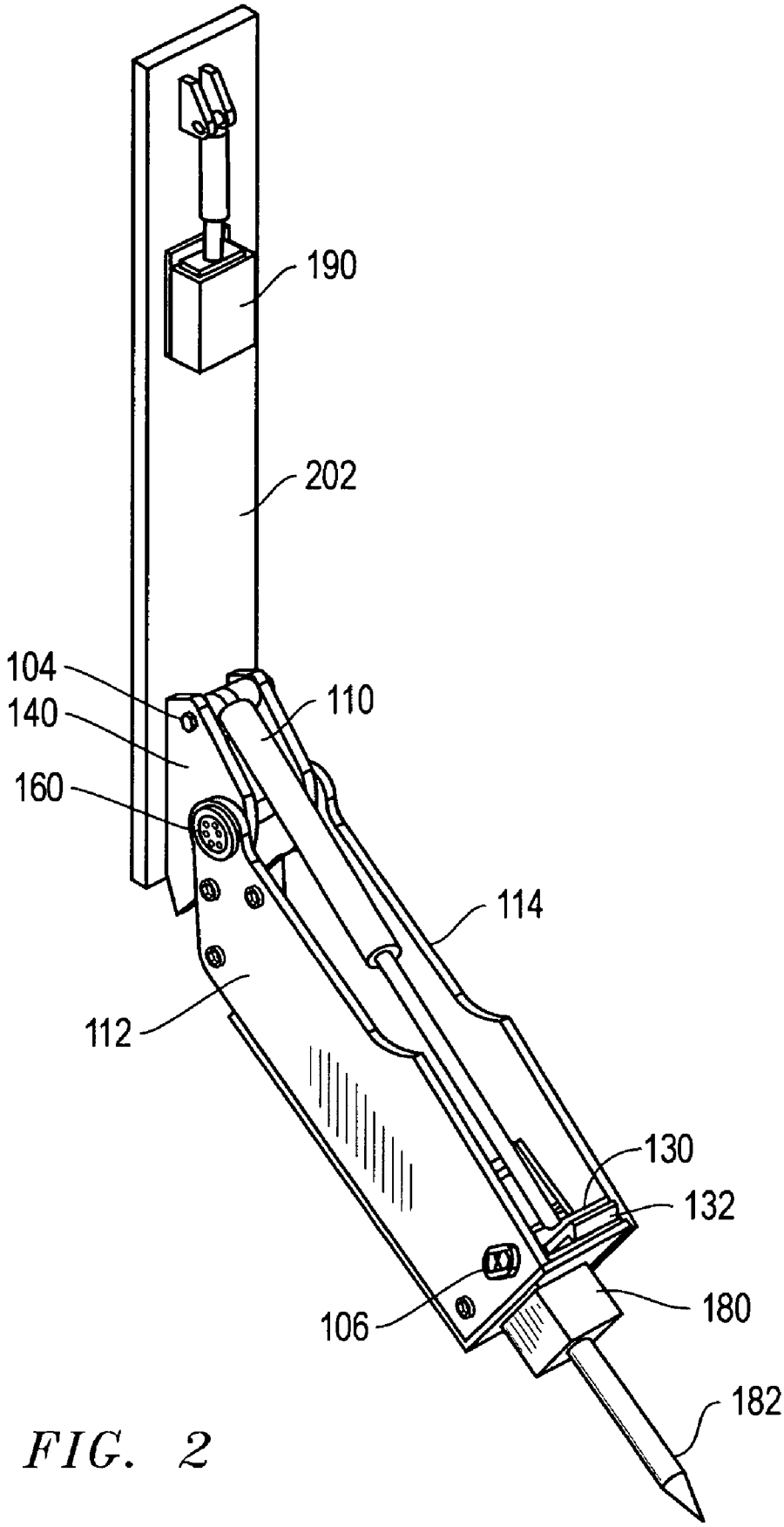
FIG. 2 is an isometric view of a breaker assembly depicted in FIG. 1.
Figure 3:
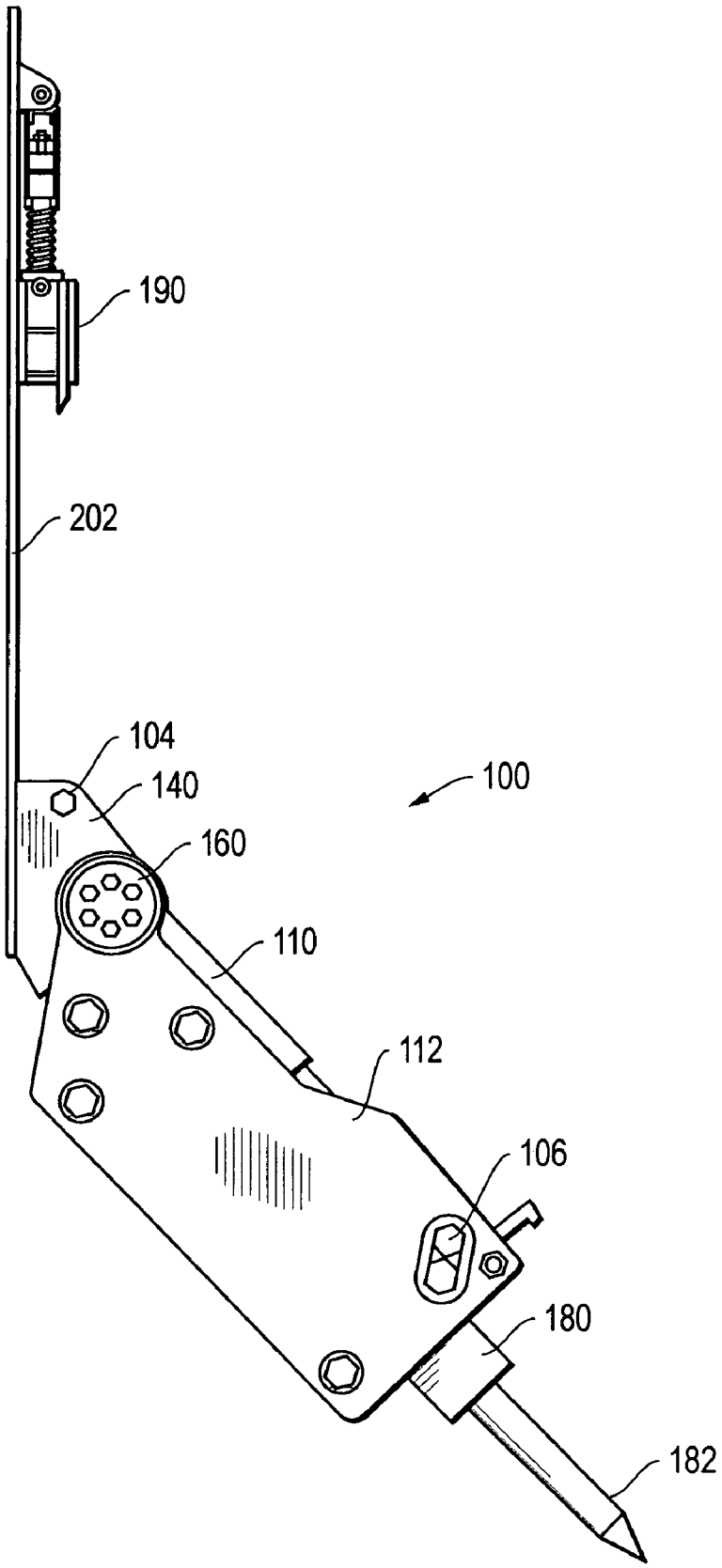
FIG. 3 is a side view of the breaker assembly and boom stick of FIG. 2.

FIGS. 2 and 3 are isometric and side views, respectively, of an alternative mounting system. FIG. 2 illustrates bracket 140 and latch 190 of FIG. 1 attached to a plate 202 by welding or other similarly secure means. In this embodiment, latch 190 can be located in proper alignment with bracket 140 and breaker assembly 100 on plate 202 prior to installation on excavating machine 10. Plate 202 can then be attached to boom stick 200. The other embodiment options disclosed herein are independent of whether plate 202 is used or not, and the various embodiments of the invention are not dependent upon the attachment option illustrated in FIGS. 2 and 3.

As shown in FIG. 1, bracket 140 is attached to boom stick 200. Referring to FIG. 2, one end of hydraulic cylinder 110 is pivotally coupled to bracket 140. The opposite end of hydraulic cylinder 110 is pivotally coupled to third pivot 106 between a first body section 112 and a second body section 114. Body sections 112 and 114 are pivotally coupled to bifurcated first pivot 102. First pivot is comprised of a pair of coaxial trunnions 160 located on bracket 140.

Figure 4:
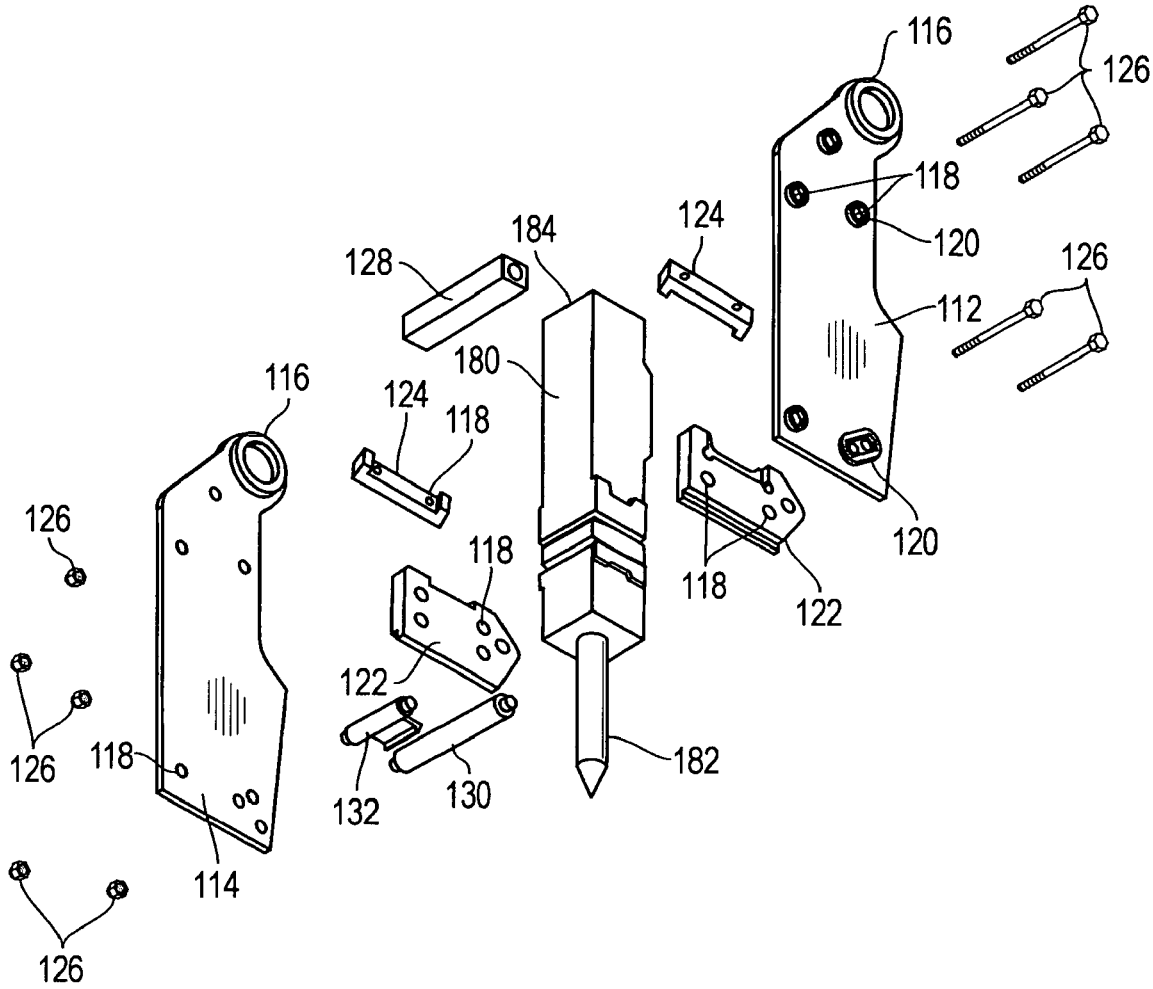
FIG. 4 is an exploded view of the breaker assembly of FIG. 1.

FIG. 4 is an exploded view of breaker assembly 100 of FIG. 1. The principal component of breaker assembly 100 is reciprocating breaker 180, also known as a hammer. Breaker 180 has a replaceable cutting tool 182 extending from one end. A breaker end 184 is located on the end of breaker 180 opposite tool 182.

In FIG. 4, body sections 112 and 114 are illustrated uncoupled. A hollow bushing 116 is provided on each of body section 112 and 114 for receiving trunnion 160 for attachment to bracket 140. A series of aligned holes 118 are provided on body sections 112 and 114 for assembly of breaker assembly 100. In the preferred embodiment, bolt protectors 120 are provided on the exterior of one of body section 112 or 114 (shown on body section 112).

A pair of opposing lower lock plates 122 and a pair of upper lock plates 124 are provided for securing breaker 180 between body sections 112 and 114. Aligned holes 118 are also located on lower lock plates 122 and upper lock plates 124. Lock plates 122 and 124 are secured between breaker 180 and body sections 112 and 114 by nut and bolt assemblies 126 passing through aligned holes 118. In the preferred embodiment, the nuts of nut and bolt assemblies 126 are of the acorn type.

A stop bar 128 is provided for bolted attachment between body sections 112 and 114 at aligned holes 118. A pivot bar 130 is provided for bolted attachment between body sections 112 and 114 at aligned holes 118. Third pivot 106 is comprised of pivot bar 130. A strike 132 is provided for bolted attachment between body sections 112 and 114 at aligned holes 118.

Figure 5:
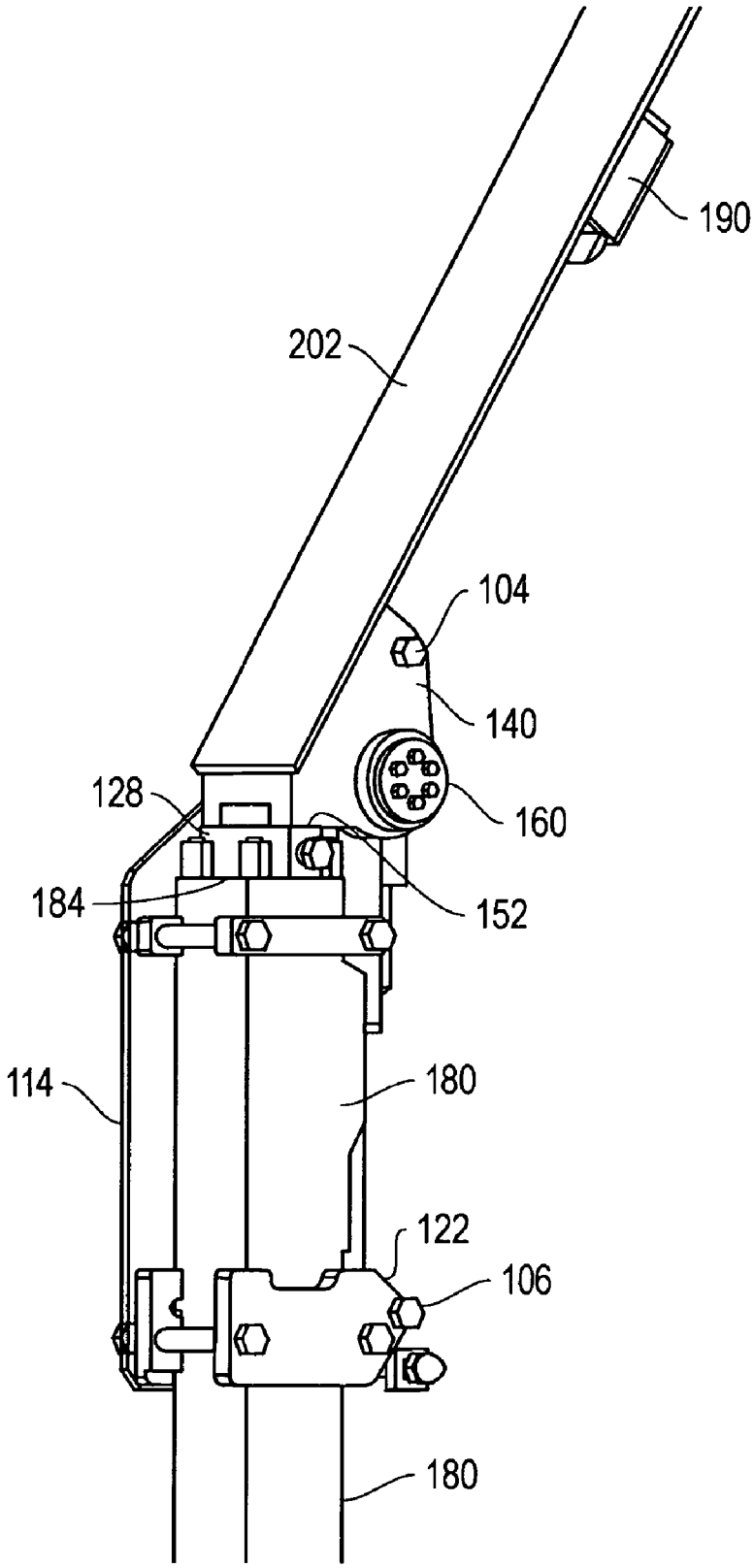
FIG. 5 is an isometric view of the breaker assembly and boom stick of FIGS. 2 and 3, shown with a side plate removed for visibility.

FIG. 5 is an isometric view of breaker assembly 100 and boom stick 200 (or plate 202) of FIGS. 2 and 3, shown with body section 112 of breaker assembly 100 removed for visibility. In this view, breaker assembly 100 is shown in the fully extended position. As seen in this view, stop member 152 is secured between body sections 112 and 114, and is located in adjacent contact with breaker end 184 of breaker 180.

Figure 6:
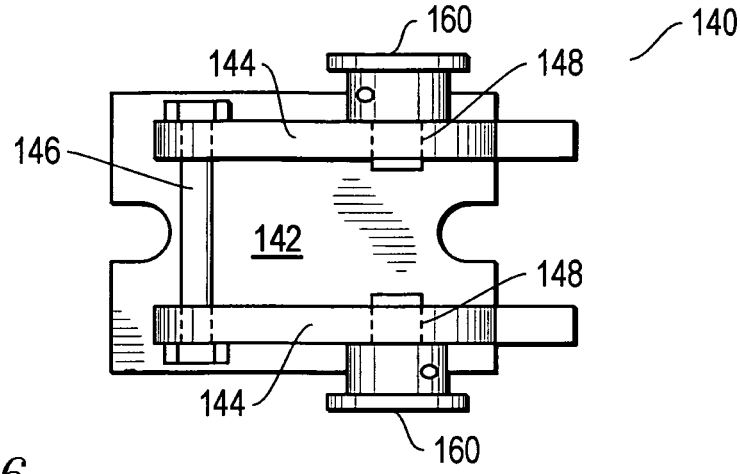
FIG. 6 is a top view of a bracket of the breaker assembly of FIG. 1.
Figure 7:
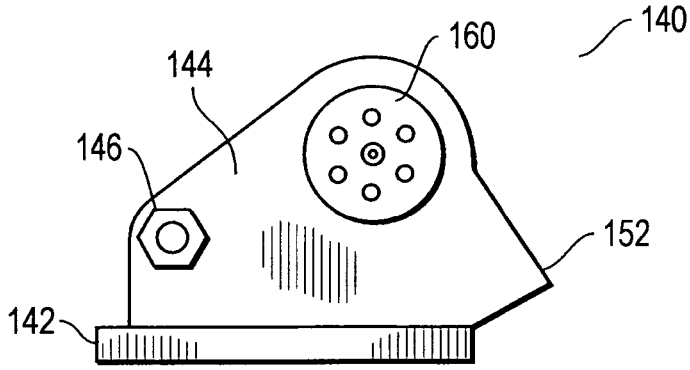
FIG. 7 is a side view of the bracket of FIG. 6.
Figure 8:
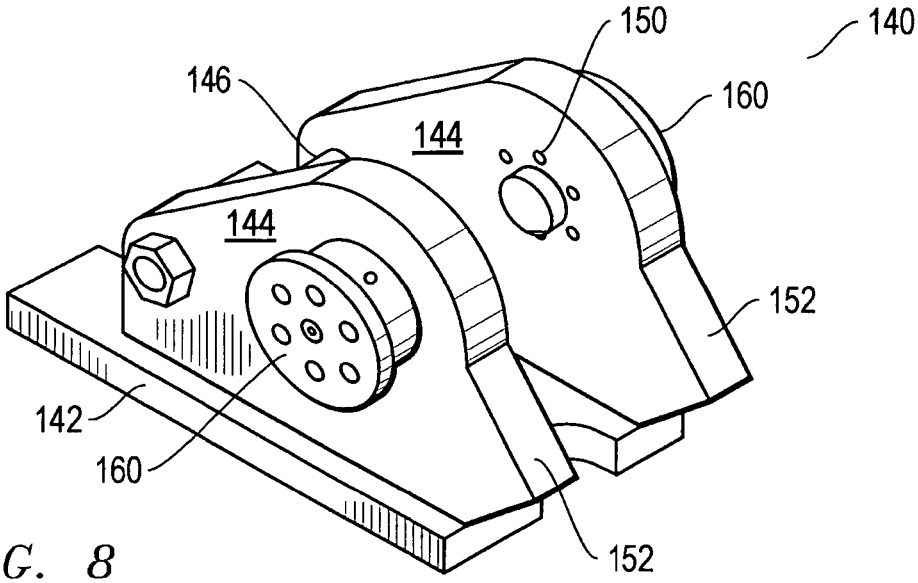
FIG. 8 is an isometric view of the bracket of FIG. 6.

FIGS. 6-8 are top, side, and isometric views, respectively, of bracket 140, in which bracket 140 is illustrated in detail. Bracket 140 comprises a base 142 and a pair of bracket sides 144 extending upwards from base 142 in substantially parallel relationship.

Second pivot 104 comprises a pivot bar 146 located between bracket sides 144. In the preferred embodiment, a pair of hub sockets 148 is coaxially located in bracket sides 144. A series of bolt holes 150 are located generally symmetrically in each of bracket sides 144. In a more preferred embodiment including hub sockets 148, bolt holes 150 are located generally symmetrically around hub sockets 148 in bracket sides 144.

In a preferred embodiment best seen in FIGS. 7 and 8, a stopping member 152 is formed on one end of each of bracket sides 144. Stop members 152 of bracket sides 144 are in substantial alignment with one another.

Figure 9:
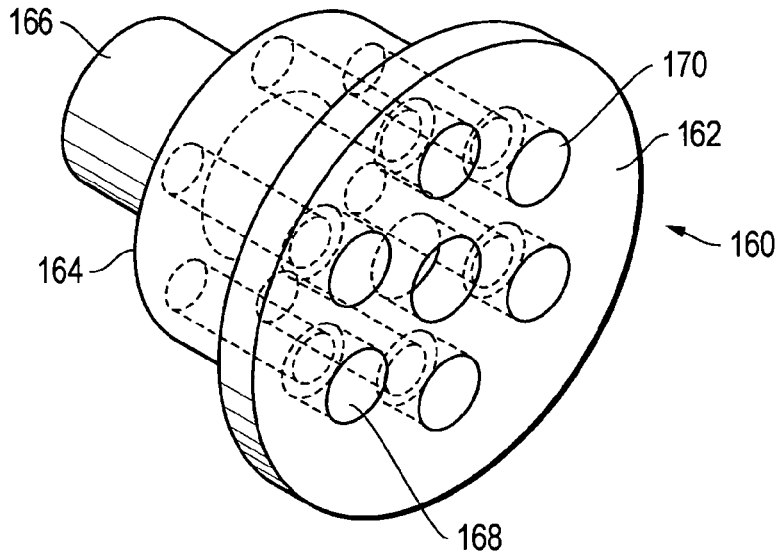
FIG. 9 is an isometric view of a trunnion of the breaker assembly of FIG. 2.
Figure 10:
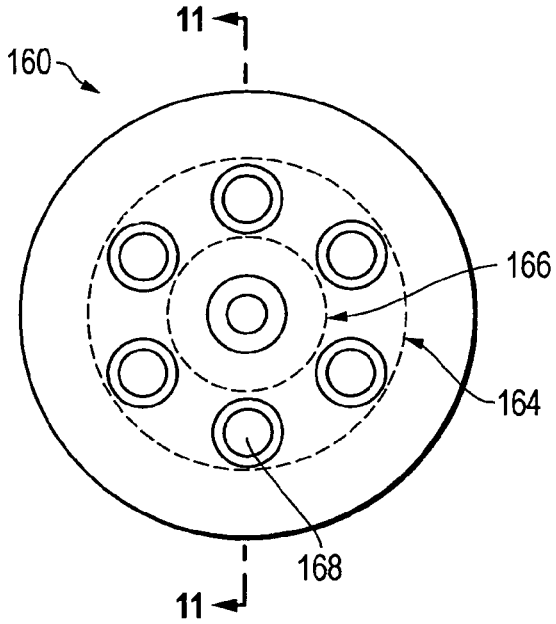
FIG. 10 is a front view of the trunnion of the breaker assembly of FIG. 2.
Figure 11:
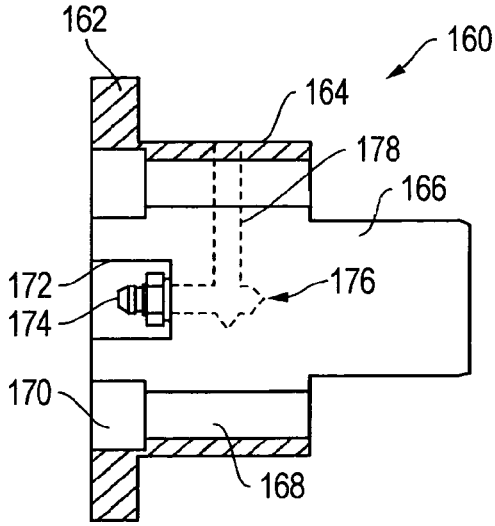
FIG. 11 is a side cross-sectional view of the trunnion of the breaker assembly of FIG. 2.

FIGS. 9-11 are isometric, front, and side cross-sectional views of trunnion 160, in which trunnion 160 is illustrated in detail. Trunnion 160 has an outer plate 162. A cylindrical bearing 164 extends coaxially inwards from outer plate 162. Bearing 164 contacts bushing 116 in a bearing relationship when breaker assembly 100 is fully assembled. In a more preferred embodiment, a hub 166 extends coaxially inwards from bearing 164.

In the preferred embodiment, a plurality of bolt holes 168 extend through outer plate 162 and cylindrical bearing 164 in generally symmetric relationship. In a more preferred embodiment including hub 166, bolt holes 168 are located in a ring around hub 166. In a more preferred embodiment, bolt holes 168 include countersunk portions 170 for receiving the heads of bolts.

In a more preferred embodiment, trunnion 160 further comprises a lubrication system 172. A lubrication connection 174, such as a grease nipple, is attached to trunnion 160, preferably within a bore 176. A fluid channel 178 connects lubrication connection 174 to the surface of cylindrical bearing 164. Optionally, fluid channel 178 may intersect the surface of bearing 164 in more than one location.

Operation of the Preferred Embodiments

Experience in field operation of an excavating tool in accordance with the disclosure of U.S. Pat. No. 6,751,896 has disclosed the opportunity for improvements in the invention of that patent, which are particular to an excavating machine having a deployable hammer pivotally attached to a boom stick. Specifically, the deployment system may suffer premature destruction of breaker assembly 100.

Referring to FIGS. 1 through 5 of the drawings, the reference numeral 100 generally designates a breaker assembly. Breaker assembly 100 is specifically designed to couple to either a new or existing boom arm, such as boom stick 200, allowing easy retrofit onto excavating machines without modification of the hydraulic system. In an alternative mounting arrangement, bracket 140 and latch 190 can be welded to a flat plate 202. By this method, breaker assembly 100 and latch 190 can be pre-aligned, simplifying and accelerating the installation of the device.

The disclosed configuration allows an excavating machine 10 to have multiple uses, and therefore reduce the cost of operation. The deployment and retraction of breaker assembly 100 is accomplished by the relationships between breaker assembly 100, boom stick 200, and hydraulic cylinder 110, as associated with the configuration first pivot 102, second pivot 104, and third pivot 106. In the most preferred embodiment, the distance between first pivot 102 and the second pivot 104 is less than the distance between first pivot 102 and third pivot 106.

As illustrated in FIG. 1, first pivot 102 and second pivot 104 are located on bracket 140. In the preferred embodiment, first pivot 102 is bifurcated. This configuration allows for the most complete retraction of breaker assembly 100 without physically interfering with first pivot 102. Hydraulic cylinder assembly 110 is pivotally attached at one end to second pivot 104 on bracket 140. Hydraulic cylinder assembly 110 is pivotally attached at its other end to third pivot 106 on breaker assembly 100. A latch 190 secures breaker assembly 100 in a retracted position. Release of latch 190 and expansion of hydraulic cylinder 110 results in quick rotation and deployment of breaker assembly 100.

In the preferred embodiment, first pivot 102 is comprised of a pair of coaxial trunnions 160 located on bracket 140. Trunnions 160 are fully illustrated in FIGS. 9, 10 and 11. Trunnions 160 provide pivotal coupling between breaker assembly 100 and bracket 140.

Second pivot 104 comprises pivot bar 146, which extends between sides 144. Pivot bar 146 provides pivotal coupling between hydraulic cylinder 110 and bracket 140.

Third pivot 106 comprises a pivot bar 130 coupled between body sections 112 and 114. Pivot bar 130 provides pivotal coupling between hydraulic cylinder 110 and breaker assembly 100.

As seen in FIGS. 6 through 8, bracket 140 is comprised of three main pieces: a base 142 and a pair of substantially parallel sides 144 extending orthogonally upwards from base 142. Coaxial hub sockets 148 are located on sides 144. Bolt holes 150 are located symmetrically around hub sockets 148. Stop members 152 are located on one end of sides 144.

As seen in FIGS. 9-11, each trunnion 160 is comprised of outer plate 162, cylindrical bearing 164, and hub 166. Bolt holes 168 are located symmetrically through outer plate 162 and cylindrical bearing 164. When trunnions 160 are inserted into bushings 116 of body sections 112 and 114, bolt holes 168 align with bolt holes 150 on bracket sides 144. This permits threaded fasteners to secure trunnions 160 to bracket 140. Countersunk portions 170 provide protection for the fasteners during excavating activities, thus adding durability to the system. Bushings 116 of body sections 112 and 114 are located on bearings 164 in a bearing relationship when breaker assembly 100 is fully assembled.

In a more preferred embodiment, trunnion 160 further comprises lubrication system 172. Lubrication system 172 comprises lubrication connection 174 at, such as a grease cert for adding grease, attached to fluid channel 178 within trunnion 160. Preferably, lubrication connection 174 is located within bore 176 to provide protection during excavating activities, thus adding durability to the tool system. Fluid channel 178 connects lubrication connection 174 to the surface of cylindrical bearing 164. Optionally, fluid channel 178 may intersect the surface of bearing 164 in more than one location.

Lubrication system 172 thus provides the advantage of a protected and accessible means of maintaining lubrication at first pivot 102, which receives the heaviest load and impacts of the system. The large bearing area provided by cylindrical bearing 164, when lubricated, has the advantage of distributing the significant impact forces of operation over a larger area. Similarly, the use of hubs 166 and multiple threaded fasteners (not illustrated) through bolt holes 150 to secure trunnions 160 to bracket 140 distributes the impact forces of operation over the collectively larger cross-sectional area of the multiple fasteners and hubs 166.

Figure 12:
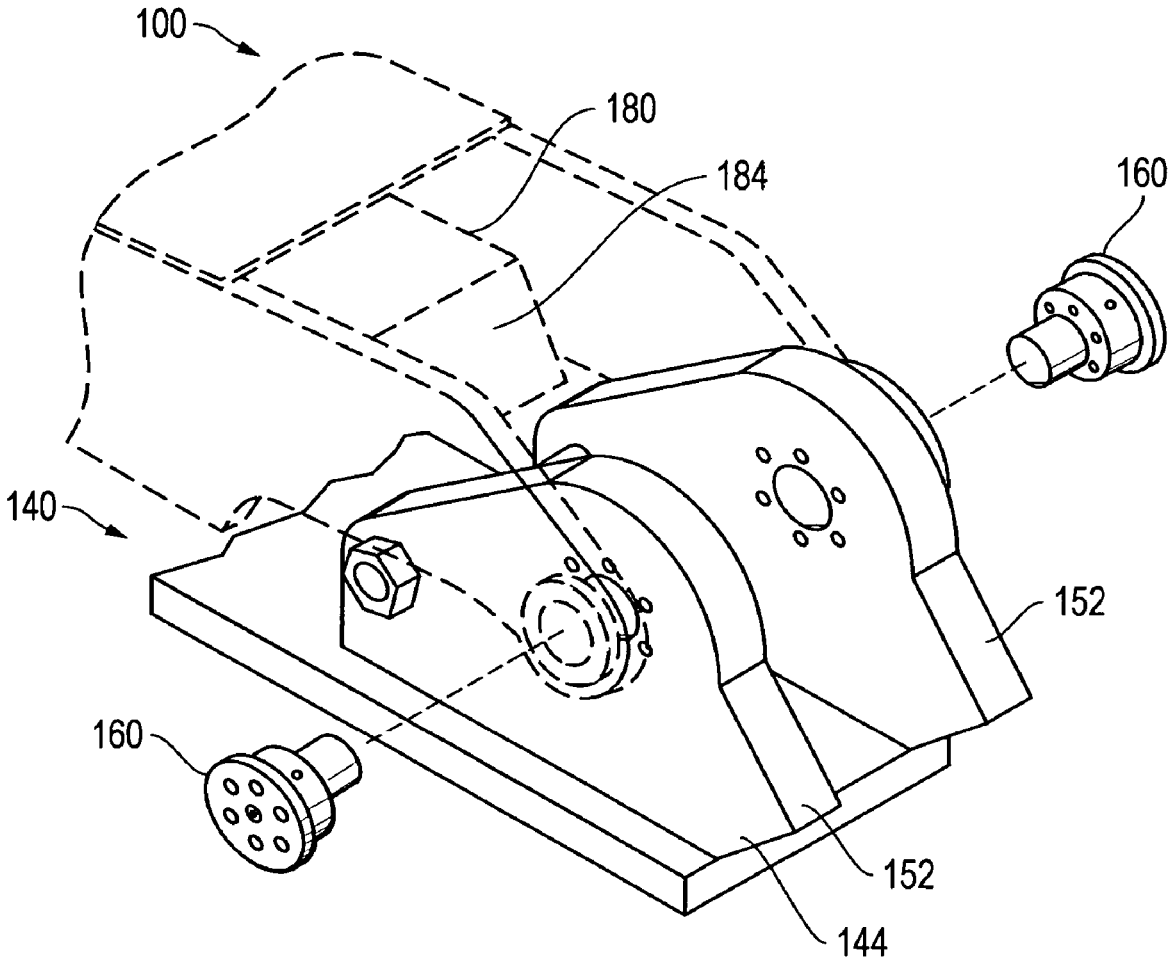
FIG. 12 is an exploded view of the trunnion and bracket of the breaker assembly of FIGS. 2 and 3.

As best seen in FIG. 12, an advantage of a preferred embodiment of the present invention is that use of trunnions 160 facilitates rapid installation and removal of breaker assembly 100 from excavation machine 10. This is necessary when reciprocating breaker 180 requires maintenance or replacement, as often occurs with high-energy tools operating in harsh environments.

As illustrated in FIG. 4, aligned holes 118 are provided on body sections 112 and 114 for assembly of breaker assembly 100. In the preferred embodiment, bolt protectors 120 are provided on the exterior of one of body section 112 or 114 (shown on body section 112) for receiving the bolt portions of nut and bolt assemblies 126. Additionally, in the preferred embodiment, the nut portions of nut and bolt assemblies 126 are of the acorn type. It has been found that fastener heads such as bolt heads and nuts can be quickly destroyed during excavating procedures making breaker assembly 100 difficult to remove and service. Thus, the configured fasteners 126 and protectors 120 provide the advantage of increased durability. Additionally, bolt protectors secure bolt portions of nut and bolt assemblies 126 from rotation, therefore having the advantage of simplifying service by only needing to apply torque tooling, such as a wrench, to the nuts portions of nut and bolt assemblies 126 located on one of body sections 112 or 114.

Nut and bolt assemblies 126 connect through aligned holes 118 to secure lower lock plates 122 and upper lock plates 124 around breaker 180 and between body sections 112 and 114. Additionally, nut and bolt assemblies 126 connect through aligned holes 118 to secure pivot bar 130, stop bar 152, and strike 132 between body sections 112 and 114 at aligned holes 118. Stop bar 152 is located immediately adjacent to breaker end 184 of breaker 180.

Strike 132 provides a means of engagement with latch 190 when it is desired to retain breaker assembly 100 in the retracted, or stowed, position. The retracted, or stowed, position is illustrated in FIG. 1.

FIG. 5 is an isometric view of breaker assembly 100 and boom stick 200 (or plate 202) with side 112 of breaker assembly 100 removed for visibility. In this view, breaker assembly 100 is shown in the fully extended position. It is necessary to limit the maximum extension of breaker assembly 100 to prevent damage to hydraulic cylinder 110. It is in the fully extended position that reciprocal breaker 180 is operating and engaging formation or matter for destruction and, thus, the position in which highest impact forces are being imparted to excavating machine 10 and breaker assembly 100.

In a preferred embodiment of the present invention illustrated in FIG. 5, stop members 152 on bracket 140 engage stop bar 128, which is abutted to breaker end 184 of breaker 180. Instead of transferring the impact forces of operation to body sections 112 and 114, the forces are transferred directly to boom stick 200 through breaker 180, stop bar 128 and bracket 140. This configuration has the advantage of preventing separation of body sections 112 and 114 and premature failure of breaker assembly 100 during operation. Besides a substantial increase in durability, this configuration simplifies construction of breaker assembly 100 and bracket 140.

Another advantage of the present invention is that the bucket can be operated without fully stowing the breaker. Likewise, the breaker may be operated without the necessity to fully extend the bucket. This increases the efficiency of the excavation process by providing immediate access to each of the tools, without delay. Another advantage of this capability is that it further increases the efficiency of the excavation process by rendering the bucket available to frequently scrape away the freshly generated cuttings so the breaker tool is always exposed to fresh refusal material, avoiding operation against previously generated cuttings. Another advantage of this capability is that by avoiding operation against previously generated cuttings, the breaker tool will last longer.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

I claim:

1. An excavating tool system for use on an excavating machine, comprising:
- a bracket attachable to an underside of a boom stick, the bracket having;
- a base;
- a pair of parallel bracket sides extending upward from the base;
- a plurality of threaded sockets located on the bracket sides;
- a bifurcated first pivot, including a pair of coaxial trunnions, the trunnions having;
- an outer plate;
- a bearing extending from the outer plate;
- a plurality of bolt holes extending through the outer plate and bearing of each trunnion in complementary alignment with the threaded sockets of the bracket sides;
- a plurality of threaded fasteners located through the bolt holes and threaded sockets, attaching a trunnion to each of the bracket sides;
- a second pivot secured to the bracket;
- an excavating tool pivotally secured at one end to the trunnions and having a third pivot located thereon between the one end and its opposite end; and,
- a hydraulic cylinder pivotally secured at one end to the second pivot and pivotally secured at the opposite end to the third pivot.

2. The excavating tool system of claim 1, further comprising:
- countersinks located at the bolt holes in the outer plates.

3. The excavating tool system of claim 1, further comprising:
- the bracket having a base;
- a pair of parallel bracket sides extending upward from the base;
- a stop member formed on each bracket side;
- a stop bar located on one end of the excavating tool; and
- wherein the stop bar engages the stop members to limit the pivotal rotation of the excavating tool.

4. The excavating tool system of claim 1 wherein the excavating tool is a breaker assembly comprising a breaker tool.

5. The excavating tool system of claim 4, the breaker assembly further comprising:
- a pair of body sections secured to opposite sides of the breaker tool;
- a bushing in each body section; and
- wherein each bushing is pivotally located on a trunnion.

6. The excavating tool system of claim 5, further comprising:
- a plurality of aligned holes on each body section;
- the aligned holes receivable of threaded fasteners; and
- bolt protectors located over the aligned holes on at least one of the body sections.

7. The excavating tool system of claim 1, further comprising:
- whereas the distance between the first pivot and the second pivot is less than the distance between the first pivot and the third pivot.

8. An excavating tool system for use on an excavating machine, comprising:
- a bracket attachable to an underside of a boom stick, the bracket having;
- a base;

a pair of parallel bracket sides extending upward from the base, having coaxially located hub sockets;

a bifurcated first pivot, including a pair of coaxial trunnions, the trunnions having;

an outer plate;

a bearing extending from the outer plate;

a hub extending from the bearing;

the trunnion hubs located in the hub sockets of the bracket sides;

a second pivot secured to the bracket;

an excavating tool pivotally secured at one end to the trunnions and having a third pivot located thereon between the one end and its opposite end; and, a hydraulic cylinder pivotally secured at one end to the second pivot and pivotally secured at the opposite end to the third pivot.

9. The excavating tool system of claim 8, further comprising:

a plurality of threaded sockets located on the bracket sides;

a plurality of bolt holes extending through the outer plate and sleeve bearing of each trunnion in complementary alignment with the threaded sockets of the bracket sides; and a plurality of threaded fasteners located through the bolt holes and threaded sockets, attaching a trunnion to each of the bracket sides.

10. The excavating tool system of claim 8, further comprising:

whereas the distance between the first pivot and the second pivot is less than the distance between the first pivot and the third pivot.

11. The excavating tool system of claim 8 wherein the excavating tool is a breaker assembly comprising a breaker tool.

12. The excavating tool system of claim 11, the breaker assembly further comprising:

a pair of body sections secured to opposite sides of the breaker tool;

a bushing in each body section; and wherein each bushing is pivotally located on a trunnion.

13. The excavating tool system of claim 12, further comprising:

a plurality of aligned holes on each body section;

the aligned holes receivable of threaded fasteners; and bolt protectors located over the aligned holes on at least one of the body sections.

14. An excavating tool system for use on an excavating machine, comprising:

a bracket attachable to an underside of a boom stick, the bracket having a bifurcated first pivot, including a pair of coaxial trunnions, the trunnions having;

an outer plate;

a cylindrical bearing extending from the outer plate;

a lubrication connection attached to the outer plate;

a fluid channel connecting the lubrication connection to the surface of the cylindrical bearing;

a second pivot secured to the bracket;

an excavating tool pivotally secured at one end to the trunnions and having a third pivot located thereon between the one end and its opposite end; and, a hydraulic cylinder pivotally secured at one end to the second pivot and pivotally secured at the opposite end to the third pivot.

15. The excavating tool system of claim 14, further comprising:

a bore located on the outer plate of each trunnion; and the lubrication connections being located in the bores.

16. The excavating tool system of claim 14, further comprising:

whereas the distance between the first pivot and the second pivot is less than the distance between the first pivot and the third pivot.

17. The excavating tool system of claim 14 wherein the excavating tool is a breaker assembly comprising a breaker tool.

18. The excavating tool system of claim 17, the breaker assembly further comprising:

a pair of body sections secured to opposite sides of the breaker tool;

a bushing in each body section; and wherein each bushing is pivotally located on a trunnion.

19. The excavating tool system of claim 18, further comprising:

a plurality of aligned holes on each body section;

the aligned holes receivable of threaded fasteners; and bolt protectors located over the aligned holes on at least one of the body sections.

* * * * *